US009774934B1

(12) United States Patent
Antila

(10) Patent No.: US 9,774,934 B1
(45) Date of Patent: Sep. 26, 2017

(54) LOW-PROFILE ELECTRONIC APPARATUS AND METHODS

(71) Applicant: Pulse Finland OY, Oulunsalo (FI)

(72) Inventor: Kimmo Antila, Kiviniemi (FI)

(73) Assignee: Pulse Finland OY (FI)

( * ) Notice: Subject to any disclaimer, the term of this patent is extended or adjusted under 35 U.S.C. 154(b) by 0 days.

(21) Appl. No.: 15/078,564

(22) Filed: Mar. 23, 2016

(51) Int. Cl.
*H04R 3/00* (2006.01)
*H04R 1/02* (2006.01)
*H04R 31/00* (2006.01)
*H04R 1/06* (2006.01)

(52) U.S. Cl.
CPC ..... *H04R 1/025* (2013.01); *H04R 1/06* (2013.01); *H04R 3/00* (2013.01); *H04R 31/006* (2013.01); *H04R 2499/11* (2013.01)

(58) Field of Classification Search
CPC .. H04R 1/26; H04R 2499/00; Y10T 28/49005
USPC ..... 381/324, 400, 394, 395
See application file for complete search history.

(56) References Cited

U.S. PATENT DOCUMENTS

2013/0229314 A1 9/2013 Kuehler et al.
2015/0110335 A1* 4/2015 Telemaque ..... H04R 9/063 381/400
2015/0229025 A1 8/2015 Kalistaja et al.
2015/0237429 A1* 8/2015 Ryan ..... H04R 1/086 381/174
2015/0375246 A1 12/2015 Kalistaja et al.

* cited by examiner

*Primary Examiner* — Melur Ramakrishnaiah

(74) *Attorney, Agent, or Firm* — Gazdzinski & Associates, PC

(57) ABSTRACT

Low-profile electronic component apparatus and methods of manufacturing and utilizing the same, for use with low-profile mobile devices and other applications. In one embodiment, the mobile device comprises a wireless-enabled smartphone, tablet, or laptop computer, and the component comprises an audio speaker which is recessed into a metallic support element, the latter recessed into the mobile device outer housing. The support element is coated with an insulating material, and conductive traces formed thereon for electrical interface with the contacts of the speaker. When assembled, the installation results in a substantially reduced overall vertical profile, thereby both potentially reducing the overall required thickness of the host device, and creating additional volume within the device housing (such as for other components, and/or enhanced audio response of the speaker) resulting in an additional spacing between the speaker component and any extant antenna assemblies.

20 Claims, 5 Drawing Sheets

LOW-PROFILE ELECTRONIC APPARATUS AND METHODS

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

TECHNOLOGICAL FIELD

The present disclosure relates generally to speaker or other electrical or electronic apparatus for use in devices such as wireless or portable audio or radio devices (e.g., mobile phones, tablet computer, portable speaker units, etc.), and more particularly in one exemplary aspect to a low-profile electronic apparatus and methods of manufacturing and utilizing the same.

DESCRIPTION OF RELATED TECHNOLOGY

Internal speakers are commonly found in most modern radio devices, such as mobile computers, tablets, mobile phones, Blackberry® devices, smartphones, personal digital assistants (PDAs), or other personal communication devices (PCD). Typically, these speakers comprise a substantially square or rectangular form factor, and include, inter alia, a moving diaphragm (aka speaker driver or cone) that is driven through the application of electrical signals to a moving coil attached to the diaphragm and driven by an electromagnet. These speakers are used to convert electrical signals to an audible output in the range of human hearing (20 Hz-20 KHz), such as to play music, render the audio portion of a video clip, etc.

Typically, these internal speaker assemblies 100 are located within the confines of the external device housing 102 (e.g., smartphone or tablet outer case), disposed on a flexible printed circuit board (PCB) of the radio device using e.g., surface mount technology (SMT) pads 104 or laser direct structuring (LDS) traces, the PCB which is mounted onto the outer plastic or metallic housing or case. See, e.g., the exemplary prior art approach depicted in FIG. 1 herein. Alternatively, the contacts can be insert-molded (using e.g., sheet metal), with which the contacts of the speaker assembly form a direct physical connection.

Using the foregoing LDS process for example, the contacts can be formed directly onto the surface of a specialized material (e.g., thermoplastic material that is doped with a metal additive). The doped metal additive is activated by means of a laser. In various typical smartphone and other applications, the underlying smartphone housing, and/or other components which the contacts or other components may be disposed on the inside of the device, may be manufactured using this specialized material, such as for example using standard injection molding processes. A laser is then used to activate areas of the (thermoplastic) material that are to be subsequently plated. Typically an electrolytic copper bath followed by successive additive layers such as nickel or gold are then added to complete the construction of the antenna. Although being very capable technology, LDS also has some disadvantages; specialized thermoplastics' material properties do not meet the properties of traditional polymer materials, but are typically more brittle or fragile.

Another disadvantage is the total cost; specialized thermoplastics' resins cost more than traditional ones, and lasering and plating processes are expensive. The capital cost of the LDS capacity also represents a significant barrier to entry into the technology.

Regardless of which of the foregoing approaches is chosen, the presence of an appreciable amount of material in the region 110 underneath the speaker assembly 102 is necessitated, as shown in FIG. 1. This in turn causes the overall profile 120 of the installed speaker assembly and host device to be larger, thereby potentially causing the overall device thickness to be greater than would otherwise be necessary. This is particularly deleterious for maintaining ultra-thin device profiles such as are typically demanded by today's smartphone, tablet, and even laptop markets. Yet further, the close proximity of the speaker component to the wireless antennae within e.g., a smartphone or tablet can result in unwanted interference between the components, such as e.g., noise coupled into the speaker, or parasitic effects on the antenna. For example, speaker components typically include metallic parts. Antennas typically radiate/perform better when the distance between the antenna pattern and metals (including e.g., the speaker component) are as large as possible. Moreover, in instances when the speaker can be placed farther away from the antenna by decreasing the lid thickness, the antenna will generally radiate better.

Even where vertical profile is not a critical attribute, any reduction in required volume consumed by a given component is typically useful/welcomed in terms of providing additional design flexibility, the ability to include or accommodate other components, and so forth.

Moreover, the acoustic properties and performance of a given speaker element or system may be adversely affected by having limitations on space on the enclosure within which it is contained or mounted. Specifically, certain speakers require a certain enclosure volume to adequately perform in certain frequency ranges, especially lower frequencies. Hence, some speakers, when installed in such enclosures, will have very sharp roll-off or non-linearity in their acoustic output as a function of frequency, which is undesirable in that it can lead to very uneven, weak performance (e.g., very poor bass response). Sometimes, even small amounts of additional volume within an enclosure can make a (small) speaker element sound "richer".

Accordingly, there is a salient need for a speaker mounting and interconnection solution for e.g., a portable audio or radio device that offers comparable electrical interconnection capabilities to prior art approaches, while being manufactured at lower cost and providing enhanced economies of space. Certain implementations of such a solution would also ideally utilize more flexible manufacturing processes, including obviating high capital investment cost-technologies such as LDS, and could even be used for mounting other types of electronic components in a low-profile manner.

SUMMARY

The present disclosure satisfies the foregoing needs by providing, inter alia, a reduced-profile and volume electronic (e.g., speaker) apparatus and methods of manufacturing.

In a first aspect of the disclosure, a speaker apparatus is disclosed. In one embodiment, the apparatus is configured for use in a portable communications device (such as a smartphone or tablet computer), and the apparatus includes an audio speaker, and a support element with at least one conductive trace, the at least one trace mated to a terminal of the audio speaker, the speaker received at least partly within an interior volume of the support element, such that the support element and speaker can be received within an aperture or recess of a host device housing.

In a second aspect of the disclosure, a portable device is disclosed. In one embodiment, the portable device includes one or more low-profile speaker apparatus disposed substantially within a housing thereof.

In another embodiment, the portable device includes: at least one audio speaker; electronic circuitry configured to drive the at least one audio speaker; an outer housing; and electronic component mounting apparatus. In one implementation, the component mounting apparatus includes: a substantially planar metallic base; a plurality of sidewall elements in communication with the substantially planar base; a substantially insulating coating applied to at least portions of the base; and at least one conductive trace applied to the insulating coating so as to form an electrical component contact for interface with one or more terminals of the at least one audio speaker. In one variant, the outer housing comprises at least one of a recess or aperture into which the electronic component mounting apparatus and at least one audio speaker may be at least partly received, such that the at least one conductive trace may interface with a corresponding electrical contact of the electronic circuitry.

In a third aspect of the disclosure, an electronic component mounting apparatus is disclosed. In one embodiment, the mounting apparatus is for use in a portable electronic device, the apparatus, and includes: a substantially planar metallic base; a plurality of sidewall elements in communication with the substantially planar base; a substantially insulating coating applied to at least portions of the base; and at least one conductive trace applied to the insulating coating so as to form an electrical component contact for interface with one or more terminals of the electronic component.

In a fourth aspect of the disclosure, a device housing element for use with one or more speaker apparatus is disclosed. In one embodiment, the housing element includes a recess within which the aforementioned support element can reside. In another embodiment, the housing element includes an aperture within which the support element can be received.

In a fifth aspect of the disclosure, a method of manufacturing a component (e.g., speaker) support element is disclosed.

In a sixth aspect of the disclosure, a method of manufacturing a portable electronic device with a low-profile speaker apparatus is disclosed.

In another aspect, a method of reducing a vertical profile of an electronic component installed within an interior volume of a device housing of a host electronic device is disclosed. In one embodiment, the method includes: forming at least one of a recess or aperture within a surface of the device housing; forming a thin-walled support element configured to receive at least a portion of the electronic component in an interior volume thereof, the support element configured to fit substantially within the at least one recess or aperture; forming at least one conductive trace on at least one surface of the support element, the at least one trace configured to enable electrical current to flow between the electronic component and a circuit of the host electronic device; disposing the support element with the at least one recess or aperture; disposing the electronic component at least partly within the support element; and bonding at least one terminal of the electronic component to the at least one trace. In one variant, the thin-walled support element and the at least one recess or aperture cooperate to cause the reduction of the vertical profile.

Further features of the present disclosure, its nature and various advantages will be more apparent from the accompanying drawings and the following detailed description.

BRIEF DESCRIPTION OF THE DRAWINGS

The features, objectives, and advantages of the disclosure will become more apparent from the detailed description set forth below when taken in conjunction with the drawings, wherein.

Figure 1:
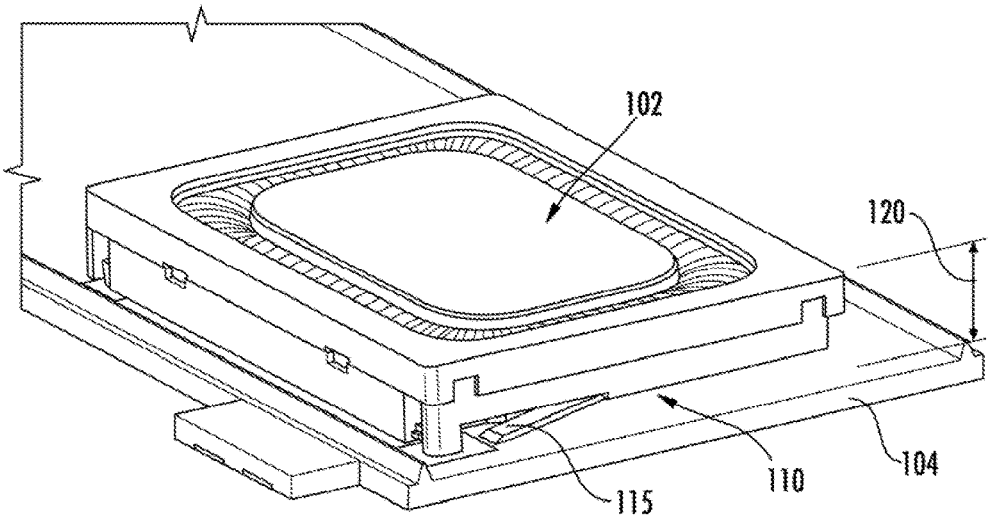
FIG. 1 (PRIOR ART)
FIG. 1 is a top perspective cross-sectional view showing a typical prior art speaker installation within a mobile device housing.

All Figures disclosed herein are © Copyright 2015-2016 Pulse Finland Oy. All rights reserved.

DETAILED DESCRIPTION OF THE PREFERRED EMBODIMENT

Reference is now made to the drawings wherein like numerals refer to like parts throughout. As used herein, the terms "board" and "substrate" refer generally and without limitation to any substantially planar, stepped, or curved surface or component upon which other components can be disposed. For example, a substrate may comprise a single or multi-layered printed circuit board (e.g., FR4), a semiconductive die or wafer, or even a surface of a housing or other device component, and may be substantially rigid or alternatively at least somewhat flexible.

As used herein, the terms "portable device", "mobile computing device", "client device", "portable computing device", and "end user device" include, but are not limited to, personal computers (PCs) and minicomputers, whether desktop, laptop, or otherwise, set-top boxes, personal digital assistants (PDAs), handheld computers, personal communicators, tablet computers, portable navigation aids, J2ME equipped devices, cellular telephones, smartphones, personal integrated communication or entertainment devices, or literally any other device capable of interchanging data with a network or another device.

As used herein, the terms "speaker", "speaker component" and "speaker element" refer without limitation to any device capable of emitting acoustic energy within one or more desired frequency ranges. Speakers may include, purely as examples, cone-and-coil type devices, piezoelectric transducers, phased array audio systems, passive radiators, sub-acoustic transducers (e.g., sub-woofers), plasma arc devices, electrostatic speakers, etc.

As used herein, the terms "top", "bottom", "side", "up", "down", "left", "right", and the like merely connote a relative position or geometry of one component to another, and in no way connote an absolute frame of reference or any required orientation. For example, a "top" portion of a component may actually reside below a "bottom" portion when the component is mounted to another device (e.g., to the underside of a PCB).

As used herein, the term "wireless" means any wireless signal, data, communication, or other interface including without limitation Wi-Fi, Bluetooth, 3G (e.g., 3GPP, 3GPP2, and UMTS), HSDPA/HSUPA, TDMA, CDMA (e.g., IS-95A, WCDMA, etc.), FHSS, DSSS, GSM, PAN/802.15, WiMAX (802.16), 802.20, narrowband/FDMA, OFDM, PCS/DCS, Long Term Evolution (LTE) or LTE-Advanced (LTE-A), analog cellular, CDPD, satellite systems such as GPS, millimeter wave or microwave systems, optical, acoustic, and infrared (i.e., IrDA).

Overview

The present disclosure provides, in one salient aspect, methods and apparatus for reducing the profile of electronic components (such as e.g., audio speakers) installed in electronic devices, such as e.g., within "thin" devices such as smartphones, tablets, and laptop computers. Concurrently, reductions in interior volume consumed by such components within the host device, and interference between such components and antennae of the host device, may be realized as well.

Advantageously, the various aspects of the present disclosure can be applied to any number of types of mobile or non-mobile devices, and also may obviate use of more costly and/or complicated processes such as laser direct structuring (LDS).

In one implementation, the methods and apparatus include replacement of a portion of the host device housing in the desired installation location with an insert or support element of significantly lower width than the surrounding housing. In this fashion, the component(s) (e.g., speaker) are recessed into the housing volume, thereby reducing their vertical profile within the interior volume of the host device.

In one variant, a direct deposition process is used to deposit conductive traces on the insert or support element in order to facilitate electrical connection and reduce manufacturing cost.

Detailed Description of Exemplary Embodiments

Detailed descriptions of the various embodiments and variants of the apparatus and methods of the disclosure are now provided. While primarily discussed in the context of audio speakers associated with mobile wireless devices such as smartphones, laptops or tablet computers, the various apparatus and methodologies discussed herein are not so limited. In fact, many of the apparatus and methodologies described herein are useful in any number of applications, whether associated with mobile or fixed devices, that can benefit from the low-profile, simplified methodologies and apparatus described herein. For example, the techniques described herein may find utility in any space-constrained device or environment where one or more electronic devices are mounted therein.

Exemplary Apparatus and Mobile Device

FIG. 1 is a top perspective cross-sectional view showing a typical prior art speaker installation within a mobile device housing. As previously discussed, the prior art approach of stacking the electronic component (e.g., speaker 102) on top of the housing element 104 such that the electrical terminals 115 contact conductive traces formed on the inside of the housing element results in a overall component vertical profile 120 which is larger than required by various implementations of the present disclosure. As noted, this results largely from the presence of a significant amount of housing material directly beneath the speaker component 102. The prior art process can also be unduly complex, and require technologies such as LDS for conductive trace formation (which includes use of housing materials that are often inferior for such processes, thereby reducing design flexibility, since such materials may not have optimal properties for other aspects of the intended application).

Referring now to FIGS. 2 through 5C, exemplary embodiments of the low profile component installation of the disclosure, and host mobile device, are described in detail.

Figure 2A:
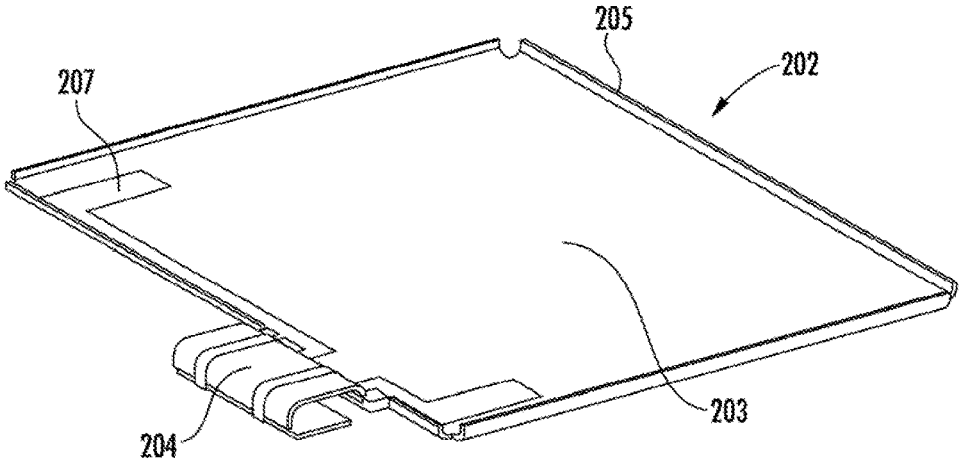
FIG. 2A is a top perspective view showing one embodiment of a low-profile component (e.g., speaker) support element for use within a mobile device housing, according to the present disclosure.

FIG. 2A is a top perspective view showing one embodiment of a low-profile component (e.g., speaker) support element 202 for use within, for example, a mobile device housing, according to the present disclosure. As shown, the support element 202 is substantially square in overall shape (when viewed from above), and includes a central substantially planar region 203, a plurality of sidewall structures 205, a plurality of conductive traces 207, and an electrical interface structure 204 formed on one side of the element 202. The element 202 is in the illustrated embodiment formed from a metallic alloy such as, without limitation, stainless steel, brass, aluminum, etc., and is formed using e.g., the process described with respect to FIGS. 4A and 4B herein, although it is appreciated that other suitable materials and/or processes may be used with equal success.

Figure 2B:
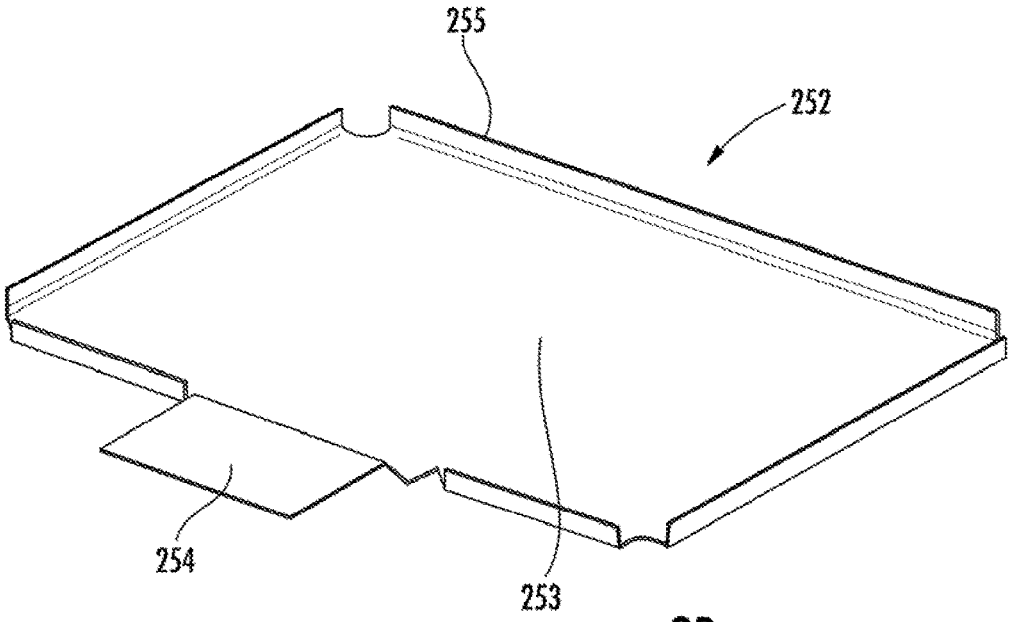
FIG. 2B is a top perspective view showing a second embodiment of a low-profile component support element for use within a mobile device housing, according to the present disclosure.

FIG. 2B is a top perspective view showing an alternative embodiment of a partially formed low-profile component (e.g., speaker) support element 252 for use within, for example, a mobile device housing, according to the present disclosure. As shown, the support element 252 is substantially square in overall shape (when viewed from above), and includes a central substantially planar region 253, a plurality of sidewall structures 255, and an electrical interface structure 254 formed on one side of the element 252. Similar to the embodiment described supra with regards to FIG. 2A, the element 252 is in the illustrated embodiment formed from a metallic alloy such as, without limitation, stainless steel, brass, aluminum, etc., and is formed using e.g., the process described with respect to FIG. 5A herein, although it is appreciated that other suitable materials and/or processes may be used with equal success. It will also be appreciated that the material of the support element illustrated in FIGS. 2A and 2B may comprise other types of substances, such as e.g., polymers, phenolics, composites, etc., and may be homogeneous or heterogeneous with the surrounding materials used within the housing element(s) 304 (see FIG. 3). Many different combinations of materials are possible, although metallic materials are generally preferred as the use of metal typically has the same strength in a thinner construction than e.g., polymer materials.

Figure 3:
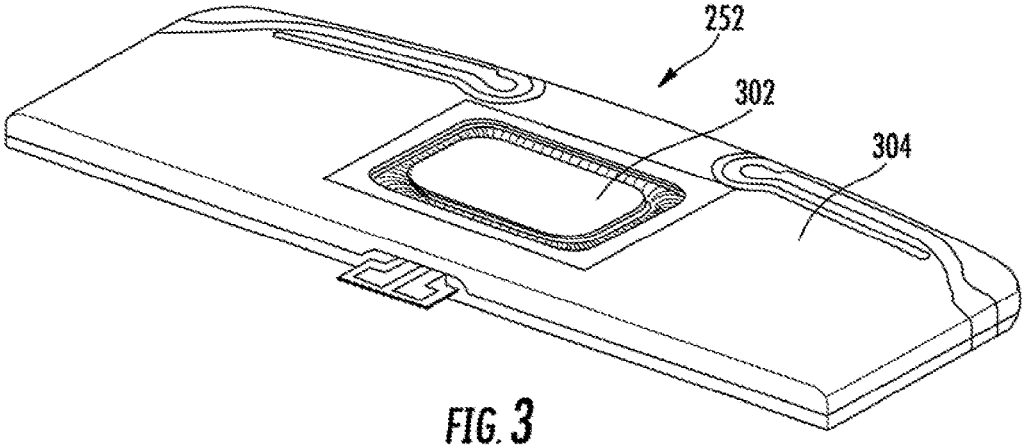
FIG. 3 is a top perspective view showing one embodiment of a low-profile speaker installation within a mobile device housing, including the support element of FIG. 2B, according to the present disclosure.

FIG. 3 is a top perspective cross-sectional view illustrating one embodiment of a low-profile speaker installation within a mobile device housing, including the support element 252 of FIG. 2B, according to the present disclosure. Moreover, although illustrated for use with the support element 252 of FIG. 2B, it is appreciated that the support element 202 of FIG. 2A, may readily be substituted as described in detail subsequently herein with regards to FIGS. 4A-4C. As shown, the speaker component 302 in this embodiment is substantially recessed into the thickness of the housing 304, thereby reducing the overall vertical profile of the installation as compared to the vertical profile 120 of FIG. 1. Such a configuration as illustrated in FIG. 3 enables a savings in the overall height (e.g., 0.5 mm) for the speaker installation as compared with typical prior art installations as shown in FIG. 1. This savings in overall height has a number of advantages. Firstly, speaker components often include a number of metal parts. As a result, when the speaker component is placed adjacent to typical antenna implementations (for example, within typical smartphone applications), the antenna performance is less than optimal. By enabling a savings in overall height, antenna implementations can be spaced farther away from the speaker component resulting in an antenna that radiates better than prior art implementations. Accordingly, and in one exemplary embodiment, such an implementation illustrated in FIG. 3 enables the overall thickness of the resultant device to be comparable to existing devices, while enabling better antenna performance.

It is also recognized that, particularly with respect to the embodiment of FIG. 3, the support element 252 (or 202, FIG. 2A) may be configured to act as a passive acoustic transducer of sorts; i.e., transmitting vibrations of air within the device housing interior volume created by the speaker element 302 through the support element to the outside environment, akin to well known acoustic passive radiator technology. This approach can be used to, for example, provide better low-frequency response of the speaker, in that the frequency radiated by the outer face of the support element is most typically within (or even below) the lower portions of the frequency response of the speaker driver (e.g., towards lower end of exemplary 50 Hz-15 kHz frequency range of a typical mobile electronic device speaker). For example, portions of the bottom planar surface 203 of the support element 202 may be made sufficiently thin (e.g., 0.1 mm-0.2 mm) and resilient enough to vibrate when excited by the speaker element 302, thereby enhancing low frequency response.

Figure 4A:
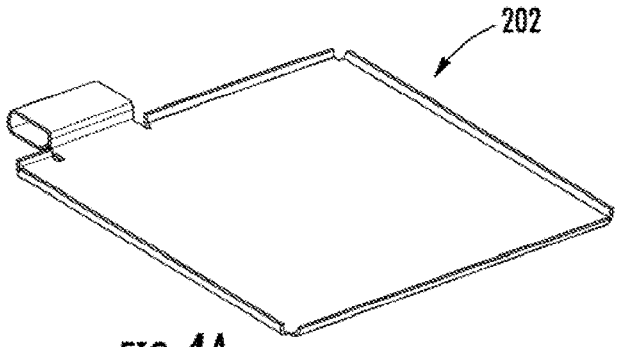
FIGS. 4A-4C are top perspective views illustrating various processing steps utilized with the low-profile speaker installation of FIG. 3 utilizing the support element of FIG. 2A, according to the present disclosure.
Figure 4B:
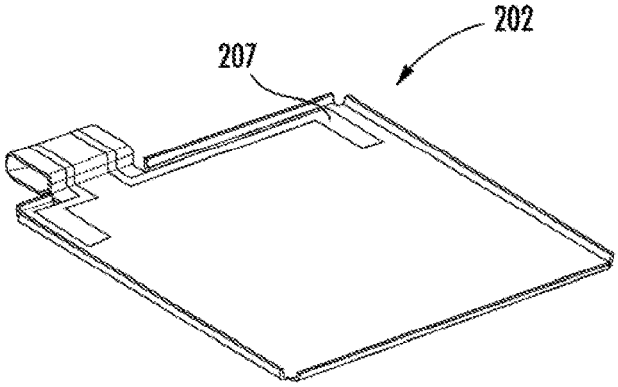
Figure 4C:
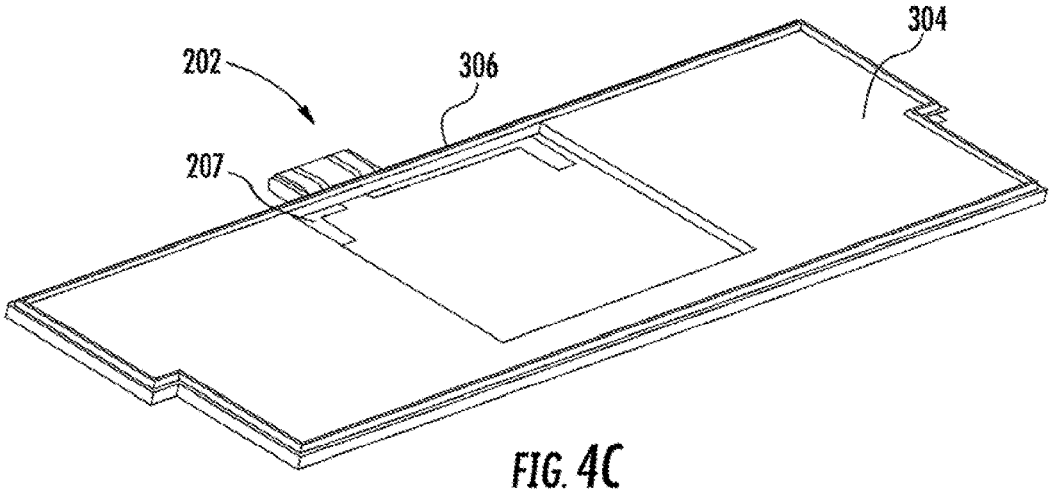

Referring now to FIGS. 4A-4C various processing steps utilized with the low-profile speaker 300 installation of FIG. 3 utilizing the support element 202 of FIG. 2A are now illustrated. FIG. 4A illustrates the stamping of support element 202 from a planar sheet of metal (e.g., 0.1 mm-0.2 mm thick sheet of stainless steel, aluminum, brass, etc.). As the support element 202 as illustrated in FIG. 4A is made from metal, the formed support element must then subsequently oxidized, painted, coated, etc., in order to isolate the metal support element 202 from the conductive traces 207 added to the support element as shown in FIG. 4B.

As shown in FIG. 4B, conductive traces 207 are added to the formed and isolated support element 202. In one variant, a conductive ink or fluid deposition technique is applied, using for example the methods and apparatus disclosed in co-owned U.S. patent application Ser. No. 14/736,040 filed Jun. 10, 2015 entitled "METHODS AND APPARATUS FOR CONDUCTIVE ELEMENT DEPOSITION AND FORMATION", which claims priority to U.S. Provisional Patent Application Ser. No. 62/018,410 filed Jun. 27, 2014 entitled "METHODS AND APPARATUS FOR CONDUCTIVE ELEMENT DEPOSITION AND FORMATION", as well as U.S. Provisional Patent Application Ser. No. 62/026,560 filed Jul. 18, 2014 entitled "METHODS AND APPARATUS FOR CONDUCTIVE ELEMENT DEPOSITION AND FORMATION", and/or co-owned and co-pending U.S. patent application Ser. No. 13/782,993 entitled "DEPOSITION ANTENNA APPARATUS AND METHODS" filed Mar. 1, 2013, which claims priority to U.S. Provisional Patent Application Ser. No. 61/606,320 of the same title filed Mar. 2, 2012, U.S. Provisional Patent Application Ser. No. 61/609,868 of the same title filed Mar. 12, 2012, and U.S. Provisional Patent Application Ser. No. 61/750,207 of the same title filed Jan. 8, 2013, and/or U.S. patent application Ser. No. 14/620,108 filed Feb. 11, 2015 and entitled "METHODS AND APPARATUS FOR CONDUCTIVE ELEMENT DEPOSITION AND FORMATION", which claims priority to U.S. Provisional Patent Application Ser. No. 61/939,197 entitled "DEPOSITION ANTENNA APPARATUS AND METHODS AND" filed Feb. 12, 2014, each of the foregoing incorporated herein by reference in its entirety. Using such techniques, the traces can be readily applied to various three-dimensional geometries, and easily cured thereafter, thereby providing a rapid and cost-efficient approach to conductive trace formation. Other techniques may be used as well, such as for example use of templates or masks combined with large area spray deposition, silk screening techniques, etc.

Referring now to FIG. 4C, the support element 202 as illustrated in FIG. 4B is insert-molded using a polymer material in order to form housing element 304 so as to enable, for example, a low-profile speaker installation as illustrated in FIG. 3. Note that in the embodiment illustrated in FIG. 4C, a thin section 306 of polymer material is insert-molded directly on top of a portion of conductive traces 207. A speaker component (such as speaker component 302 illustrated in FIG. 3) may then subsequently attached to the conductive traces 207, thereby completing the assembly.

Figure 5A:
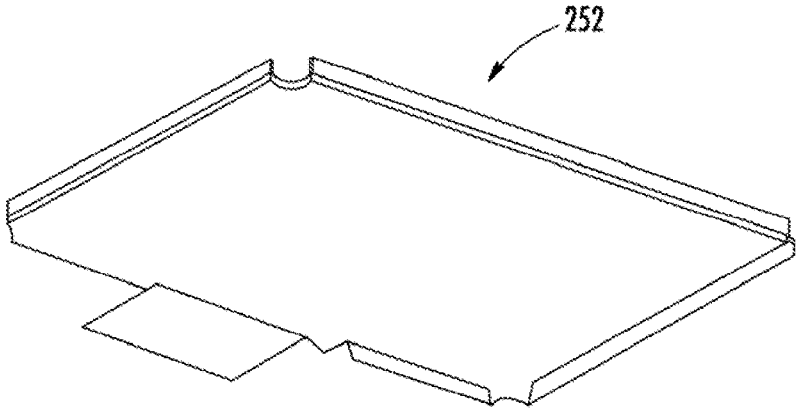
FIGS. 5A-5C are top perspective views illustrating various processing steps utilized with the low-profile speaker installation of FIG. 3 utilizing the support element of FIG. 2B, according to the present disclosure.
Figure 5B:
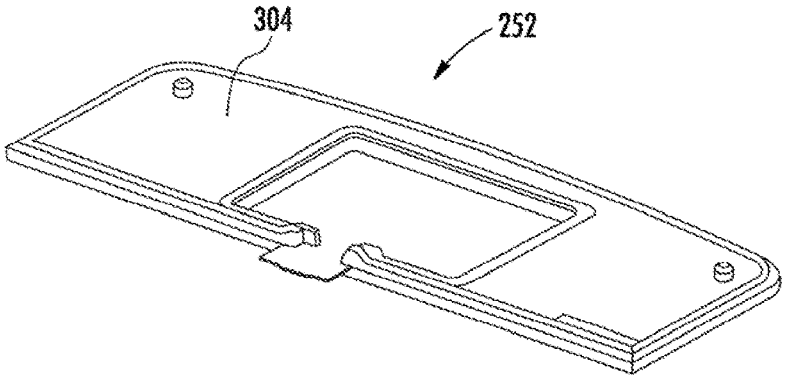
Figure 5C:
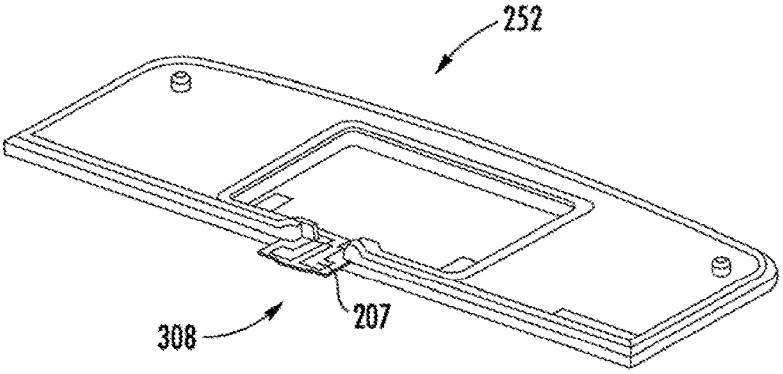

Referring now to FIGS. 5A-5C various processing steps utilized with the low-profile speaker 300 installation of FIG. 3 utilizing the support element 252 of FIG. 2B are now illustrated. FIG. 5A illustrates the stamping of support element 252 from a planar sheet of metal (e.g., 0.1 mm-0.2 mm thick sheet of stainless steel, aluminum, brass, etc.). As the support element 252 as illustrated in FIG. 5A is made from metal, the formed support element must then subsequently oxidized, painted, coated, etc., in order to isolate the metal support element 252 from the conductive traces 207 added to the support element as shown in FIG. 5C.

Referring now to FIG. 5B, the support element 252 as illustrated in FIG. 5A is insert-molded using a polymer material in order to form housing element 304 so as to enable, for example, a low-profile speaker installation as illustrated in FIG. 3. Note that in the embodiment illustrated in FIG. 5B, a gapped section 308 is introduced into the insert-molded polymer material housing 304 so as to enable the application of conductive traces 207 to the support element 252 as shown in FIG. 5C.

As shown in FIG. 5C, conductive traces 207 are added to the formed and isolated support element 252. In one variant, a conductive ink or fluid deposition technique is applied, using for example the methods and apparatus disclosed in co-owned U.S. patent application Ser. No. 14/736,040 filed Jun. 10, 2015 entitled "METHODS AND APPARATUS FOR CONDUCTIVE ELEMENT DEPOSITION AND FORMATION", which claims priority to U.S. Provisional Patent Application Ser. No. 62/018,410 filed Jun. 27, 2014 entitled "METHODS AND APPARATUS FOR CONDUCTIVE ELEMENT DEPOSITION AND FORMATION", as well as U.S. Provisional Patent Application Ser. No. 62/026,560 filed Jul. 18, 2014 entitled "METHODS AND APPARATUS FOR CONDUCTIVE ELEMENT DEPOSITION AND FORMATION", and/or co-owned and co-pending U.S. patent application Ser. No. 13/782,993 entitled "DEPOSITION ANTENNA APPARATUS AND METHODS AND" filed Mar. 1, 2013, which claims priority to U.S. Provisional Patent Application Ser. No. 61/606,320 of the same title filed Mar. 2, 2012, U.S. Provisional Patent Application Ser. No. 61/609,868 of the same title filed Mar. 12, 2012, and U.S. Provisional Patent Application Ser. No. 61/750,207 of the same title filed Jan. 8, 2013, and/or U.S. patent application Ser. No. 14/620,108 filed Feb. 11, 2015 and entitled "METHODS AND APPARATUS FOR CONDUCTIVE ELEMENT DEPOSITION AND FORMATION", which claims priority to U.S. Provisional Patent Application Ser. No. 61/939,197 entitled "DEPOSITION ANTENNA APPARATUS AND METHODS" filed Feb. 12, 2014, each of the foregoing incorporated supra. Using such techniques, the traces can be readily applied to various three-dimensional geometries, and easily cured thereafter, thereby providing a rapid and cost-efficient approach to conductive trace formation. Again note that the introduction a gapped section 308 enables the conductive traces to be formed subsequent to the injection-molding process as illustrated in FIG. 5B. Other techniques may be used as well, such as for example use of templates or masks combined with large area spray deposition, silk screening techniques, etc. A speaker component (such as speaker component 302 illustrated in FIG. 3) may then subsequently attached to the conductive traces 207, thereby completing the assembly.

Methods of Manufacturing—

Figure 6:
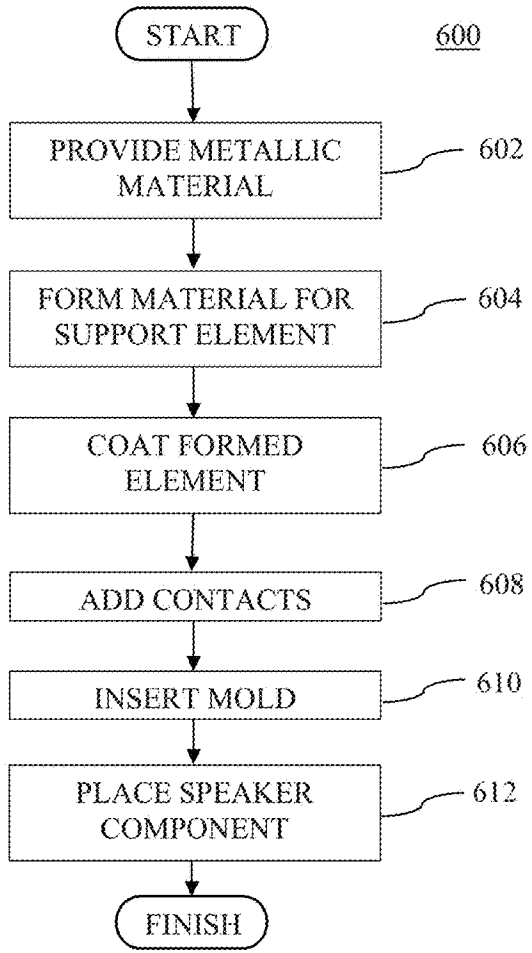
FIG. 6 is a logical flow diagram illustrating one embodiment of a method of manufacturing the low-profile speaker installation of FIG. 3 utilizing the support element of FIG. 2A, according to the present disclosure.

FIG. 6 is a logical flow diagram illustrating one embodiment of a method 600 of manufacturing a speaker installation using the support element 202 of FIG. 2A. As shown in FIG. 6, the method 600 includes first providing the necessary material to form the support element 202 per step 602. In one implementation, the support element is formed from a sheet or roll of alloy, such as stainless steel, aluminum, brass, etc., and has in an exemplary implementation, a thickness of between 0.1 mm and 0.2 mm, although other material thicknesses are possible. Next, the necessary shape is cut from the material sheet or roll, such as via punching, laser cutting, or other such technique. It will be appreciated that the exemplary configuration of the support element 202 shown in FIG. 2A can be readily fabricated from a flat sheet, although this is by no means a requirement of the present disclosure.

Next, per step 604, the (two dimensional) material shape is formed into the three-dimensional shape shown in FIG. 2A. Such forming can be accomplished using e.g., a die over which the material shape can be deformed, via applying individual bends to the material, or yet other techniques. Moreover, the shape illustrated in FIG. 2A may in alternative embodiments be accomplished by milling/machining a block of material in order to accomplish the shape illustrated in FIG. 2A.

Next, per step 606, the formed support element 202 is then coated wholly or partly with an electrically insulating material. For example, in one embodiment the coating can be applied using any number of techniques including vapor deposition, spraying (e.g., via atomization gun), dip-coating, etc. In one implementation, the coating is deposited so as to provide adequate electrical insulation yet not unnecessarily increase the thickness of the support element 202 as a whole. Alternatively, the support element may be oxidized using well understood techniques in order to provide the requisite level of insulation. It is also appreciated that the aforementioned coating can be applied prior to any of the steps of the method 600, e.g., at time of manufacture of the sheet/roll stock, or before deformation but after cutting.

Next, per step 608, the conductive traces are disposed onto the relevant support element surfaces. In one variant, a conductive ink or fluid deposition technique is applied, using for example the methods and apparatus disclosed in co-owned U.S. patent application Ser. No. 14/736,040 filed Jun. 10, 2015 entitled "METHODS AND APPARATUS FOR CONDUCTIVE ELEMENT DEPOSITION AND FORMATION", which claims priority to U.S. Provisional Patent Application Ser. No. 62/018,410 filed Jun. 27, 2014 entitled "METHODS AND APPARATUS FOR CONDUCTIVE ELEMENT DEPOSITION AND FORMATION", as well as U.S. Provisional Patent Application Ser. No. 62/026,560 filed Jul. 18, 2014 entitled "METHODS AND APPARATUS FOR CONDUCTIVE ELEMENT DEPOSITION AND FORMATION", and/or co-owned and co-pending U.S. patent application Ser. No. 13/782,993 entitled "DEPOSITION ANTENNA APPARATUS AND METHODS" filed Mar. 1, 2013, which claims priority to U.S. Provisional Patent Application Ser. No. 61/606,320 of the same title filed Mar. 2, 2012, U.S. Provisional Patent Application Ser. No. 61/609,868 of the same title filed Mar. 12, 2012, and U.S. Provisional Patent Application Ser. No. 61/750,207 of the same title filed Jan. 8, 2013, and/or U.S. patent application Ser. No. 14/620,108 filed Feb. 11, 2015 and entitled "METHODS AND APPARATUS FOR CONDUCTIVE ELEMENT DEPOSITION AND FORMATION", which claims priority to U.S. Provisional Patent Application Ser. No. 61/939,197 entitled "DEPOSITION ANTENNA APPARATUS AND METHODS" filed Feb. 12, 2014, each of the foregoing incorporated herein by reference supra. Using such techniques, the traces can be readily applied to various three-dimensional geometries, and easily cured thereafter, thereby providing a rapid and cost-efficient approach to conductive trace formation. Other techniques may be used as well, such as for example use of templates or masks combined with large area spray deposition, silk screening techniques, etc. As above, the conductive trace deposition and/or curing process (if required) can be performed at various points within the manufacturing method 500, such as at time of material stock fabrication, after cutting but before forming, etc. The conductive traces can also be formed in two or more parts, such as where one portion is deposited prior to material deformation, and another deposited after the deformation, so as to ensure that the trace electrical and mechanical properties are not compromised during bending or deformation of the underlying material.

Next, at step 610, the support element 202 is insert molded using a polymer material in order to form the polymer housing. While the use of insert-molding is exemplary, it is readily appreciated that other known techniques may be utilized such as transfer molding techniques, etc.

Finally, at step 612, the speaker component 302 is placed within the support element 202 and the conductive leads present on the speaker component are attached to the conductive traces 207 thereby finishing the manufacturing process.

Figure 7:
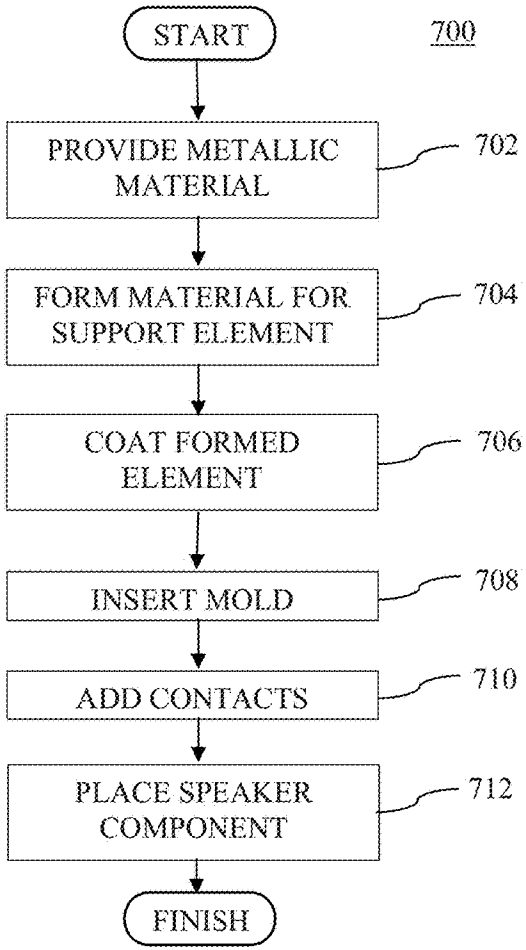
FIG. 7 is a logical flow diagram illustrating one embodiment of a method of manufacturing the low-profile speaker installation of FIG. 3 utilizing the support element of FIG. 2B, according to the present disclosure.

FIG. 7 is a logical flow diagram illustrating one embodiment of a method 700 of manufacturing a speaker installation using the support element 252 of FIG. 2B. As shown in FIG. 7, the method 700 includes first providing the necessary material to form the support element 252 per step 702. In one implementation, the support element is formed from a sheet or roll of alloy, such as stainless steel, aluminum, brass, etc., and has in an exemplary implementation, a thickness of between 0.1 mm and 0.2 mm, although other material thicknesses are possible. Next, the necessary shape is cut from the material sheet or roll, such as via punching, laser cutting, or other such technique. It will be appreciated that the exemplary configuration of the support element 252 shown in FIG. 2B can be readily fabricated from a flat sheet, although this is by no means a requirement of the present disclosure.

Next, per step 704, the (two dimensional) material shape is formed into the three-dimensional shape shown in FIG. 2B. Such forming can be accomplished using e.g., a die over which the material shape can be deformed, via applying individual bends to the material, or yet other techniques. Moreover, the shape illustrated in FIG. 2B may in alternative embodiments be accomplished by milling/machining a block of material in order to accomplish the shape illustrated in FIG. 2B.

Next, per step 706, the formed support element 252 is then coated wholly or partly with an electrically insulating material. For example, in one embodiment the coating can be applied using any number of techniques including vapor deposition, spraying (e.g., via atomization gun), dip-coating, etc. In one implementation, the coating is deposited so as to provide adequate electrical insulation yet not unnecessarily increase the thickness of the support element 252 as a whole. Alternatively, the support element may be oxidized using well understood techniques in order to provide the requisite level of insulation. It is also appreciated that the aforementioned coating can be applied prior to any of the steps of the method 700, e.g., at time of manufacture of the sheet/roll stock, or before deformation but after cutting.

Next, at step 710, the support element 252 is insert molded using a polymer material in order to form the polymer housing. While the use of insert-molding is exemplary, it is readily appreciated that other known techniques may be utilized such as transfer molding techniques, etc. Moreover, the support element 252 and the housing element 304 may be separately formed with the support element 252 subsequently post-inserted into the housing element (i.e., after the housing element 304 has been formed)

Next, per step 710, the conductive traces are disposed onto the relevant support element surfaces. In one variant, a conductive ink or fluid deposition technique is applied, using for example the methods and apparatus disclosed in co-owned U.S. patent application Ser. No. 14/736,040 filed Jun. 10, 2015 entitled "METHODS AND APPARATUS FOR CONDUCTIVE ELEMENT DEPOSITION AND FORMATION", which claims priority to U.S. Provisional Patent Application Ser. No. 62/018,410 filed Jun. 27, 2014 entitled "METHODS AND APPARATUS FOR CONDUCTIVE ELEMENT DEPOSITION AND FORMATION", as well as U.S. Provisional Patent Application Ser. No. 62/026,560 filed Jul. 18, 2014 entitled "METHODS AND APPARATUS FOR CONDUCTIVE ELEMENT DEPOSITION AND FORMATION", and/or co-owned and co-pending U.S. patent application Ser. No. 13/782,993 entitled "DEPOSITION ANTENNA APPARATUS AND METHODS" filed Mar. 1, 2013, which claims priority to U.S. Provisional Patent Application Ser. No. 61/606,320 of the same title filed Mar. 2, 2012, U.S. Provisional Patent Application Ser. No. 61/609,868 of the same title filed Mar. 12, 2012, and U.S. Provisional Patent Application Ser. No. 61/750,207 of the same title filed Jan. 8, 2013, and/or U.S. patent application Ser. No. 14/620,108 filed Feb. 11, 2015 and entitled "METHODS AND APPARATUS FOR CONDUCTIVE ELEMENT DEPOSITION AND FORMATION", which claims priority to U.S. Provisional Patent Application Ser. No. 61/939,197 entitled "DEPOSITION ANTENNA APPARATUS AND METHODS" filed Feb. 12, 2014, each of the foregoing incorporated herein by reference supra. Using such techniques, the traces can be readily applied to various three-dimensional geometries, and easily cured thereafter, thereby providing a rapid and cost-efficient approach to conductive trace formation. Other techniques may be used as well, such as for example use of templates or masks combined with large area spray deposition, silk screening techniques, etc. As above, the conductive trace deposition and/or curing process (if required) can be performed at various points within the manufacturing method 500, such as at time of material stock fabrication, after cutting but before forming, etc. The conductive traces can also be formed in two or more parts, such as where one portion is deposited prior to material deformation, and another deposited after the deformation, so as to ensure that the trace electrical and mechanical properties are not compromised during bending or deformation of the underlying material.

Finally, at step 712, the speaker component 302 is placed within the support element 252 and the conductive leads present on the speaker component are attached to the conductive traces 207 thereby finishing the manufacturing process.

It will be recognized that while certain aspects of the disclosure are described in terms of a specific sequence of steps of a method, these descriptions are only illustrative of the broader methods of the disclosure, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the disclosure disclosed and claimed herein.

While the above detailed description has shown, described, and pointed out novel features of the disclosure as applied to various embodiments, it will be understood that various omissions, substitutions, and changes in the form and details of the device or process illustrated may be made by those skilled in the art without departing from the disclosure. The foregoing description is of the best mode presently contemplated of carrying out the disclosure. This description is in no way meant to be limiting, but rather should be taken as illustrative of the general principles of the disclosure. The scope of the disclosure should be determined with reference to the claims.

What is claimed is:

1. Portable electronic apparatus, comprising:

at least one audio speaker;

electronic circuitry configured to drive the at least one audio speaker;

an outer housing;

at least one antenna configured to radiate electromagnetic radiation; and electronic component mounting apparatus comprising:

a substantially planar metallic base;

a plurality of sidewall elements in communication with the substantially planar metallic base;

a substantially insulating coating applied to at least portions of the substantially metallic planar base; and at least one conductive trace applied to the substantially insulating coating so as to form an electrical component contact for interface with one or more terminals of the at least one audio speaker;

wherein the outer housing comprises at least one of a recess or aperture into which the electronic component mounting apparatus and the at least one audio speaker may be at least partly received, such that the at least one conductive trace may interface with a corresponding electrical contact of the electronic circuitry; and wherein the at least one recess or aperture and the electronic component mounting apparatus cooperate to maintain at least a predetermined distance between the at least one antenna and the at least one audio speaker so as to mitigate interference between the at least one audio speaker and the at least one antenna.

2. The portable electronic apparatus of claim 1, wherein the at least one recess or aperture and the electronic component mounting apparatus cooperate to minimize a vertical profile of the at least one audio speaker so as to create additional space within an interior volume of the outer housing.

3. The portable electronic apparatus of claim 1, wherein the at least one recess or aperture and the electronic component mounting apparatus cooperate to minimize a vertical profile of the at least one audio speaker so as enable optimization of an interior volume of the outer housing for an acoustic response of the at least one speaker.

4. The portable electronic apparatus of claim 1, wherein the electronic component mounting apparatus is insert-molded within the outer housing.

5. The portable electronic apparatus of claim 4, wherein at least a portion of the at least one conductive trace is covered by a portion of the outer housing.

6. The portable electronic apparatus of claim 4, further comprising one or more antenna apparatus, the use of the electronic component mounting apparatus being configured to provide a greater distance between the at least one audio speaker and the one or more antenna apparatus as compared with a portable electronic apparatus without the electronic component mounting apparatus.

7. The portable electronic apparatus of claim 4, wherein the electronic component mounting apparatus is formed from a single piece of metallic material.

8. The portable electronic apparatus of claim 7, wherein the electronic component mounting apparatus further comprises an electrical interface structure.

9. The portable electronic apparatus of claim 8, wherein the electrical interface structure comprises at least a portion of the at least one conductive trace formed thereon.

10. The portable electronic apparatus of claim 9, wherein the electrical interface structure comprises a three-dimensional structure.

11. The portable electronic apparatus of claim 1, wherein the substantially planar metallic base and the plurality of sidewall elements in communication with the substantially planar metallic base comprise a single unitary structure.

12. Portable electronic apparatus, comprising:

at least one audio speaker;

electronic circuitry configured to drive the at least one audio speaker;

an outer housing;

electronic component mounting apparatus comprising:

a substantially planar metallic base;

a plurality of sidewall elements in communication with the substantially planar metallic base;

a substantially insulating coating applied to at least portions of the substantially planar metallic base; and at least one conductive trace applied to the substantially insulating coating so as to form an electrical component contact for interface with one or more terminals of the at least one audio speaker; and one or more antenna apparatus, the use of the electronic component mounting apparatus being configured to provide a greater distance between the at least one audio speaker and the one or more antenna apparatus as compared with a portable electronic apparatus without the electronic component mounting apparatus;

wherein the outer housing comprises at least one of a recess or aperture into which the electronic component mounting apparatus and the at least one audio speaker may be at least partly received such that the at least one conductive trace may interface with a corresponding electrical contact of the electronic circuitry; and wherein the electronic component mounting apparatus is insert-molded within the outer housing.

13. The portable electronic apparatus of claim 12, further comprising at least one antenna configured to radiate electromagnetic radiation; and wherein the at least one recess or aperture, and the electronic component mounting apparatus cooperate to maximize a distance between the at least one antenna and the at least one audio speaker so as to mitigate interference between the at least one audio speaker and the at least one antenna.

14. The portable electronic apparatus of claim 12, wherein the at least one recess or aperture and the electronic component mounting apparatus are configured to cooperate to minimize a vertical profile of the at least one audio speaker so as create additional space within an interior volume of the outer housing.

15. The portable electronic apparatus of claim 12, wherein the at least one recess or aperture, and the electronic component mounting apparatus are configured to cooperate to minimize a vertical profile of the at least one audio speaker so as enable optimization of an interior volume of the outer housing for an acoustic response of the at least one speaker.

16. The portable electronic apparatus of claim 12, wherein at least a portion of the at least one conductive trace is covered by a portion of the outer housing.

17. The portable electronic apparatus of claim 12, wherein the electronic component mounting apparatus is formed from a single piece of metallic material.

18. The portable electronic apparatus of claim 17, wherein the electronic component mounting apparatus further comprises an electrical interface structure.

19. The portable electronic apparatus of claim 18, wherein the electrical interface structure comprises at least a portion of the at least one conductive trace formed thereon.

20. The portable electronic apparatus of claim 19, wherein the electrical interface structure comprises a three-dimensional structure.

* * * * *